United States Patent [19]

Spotts et al.

[11] 4,084,491

[45] Apr. 18, 1978

[54] OSCILLATED LOUVER ASSEMBLY FOR BREEZE BOX FAN

[75] Inventors: Willard Spotts, Boonville; Thomas P. Arrandale; Glenn R. Spotts, both of Moberley, all of Mo.

[73] Assignee: McGraw-Edison Company, Elgin, Ill.

[21] Appl. No.: 675,711

[22] Filed: Apr. 12, 1976

[51] Int. Cl.[2] ..... F04D 25/08

[52] U.S. Cl. ..... 98/121 A; 415/125

[58] Field of Search ..... 415/125; 98/121 A, 114; 49/87, 88

[56] References Cited

U.S. PATENT DOCUMENTS

| | | | |
|---|---|---|---|
| 697,448 | 4/1902 | Coleman | 415/125 |
| 2,037,250 | 4/1936 | MacDonald | 415/125 |
| 3,303,772 | 2/1967 | Wheatley | 98/121 R X |
| 3,345,930 | 10/1967 | Ammons | 98/121 R X |
| 3,380,372 | 4/1968 | Perry | 98/121 A |
| 3,699,873 | 10/1972 | Irvin | 415/125 |
| 3,996,845 | 12/1976 | Harris | 98/121 R X |
| 4,007,673 | 2/1977 | Zaloga | 415/125 X |

FOREIGN PATENT DOCUMENTS

| | | | |
|---|---|---|---|
| 2,224,291 | 11/1973 | Germany | 415/125 |
| 451,597 | 8/1936 | United Kingdom | 415/125 |

*Primary Examiner*—Everette A. Powell, Jr.
*Attorney, Agent, or Firm*—Ronald J. LaPorte

[57] ABSTRACT

This invention teaches an air distributor accessory device for a breeze box type fan having an annular case and having fan blades supported to rotate within the confines of this case. The accessory device is designed to fit against and be secured to the front face of the fan case, and itself has an annular frame that pivotally supports a plurality of vanes in generally parallel relation. Each vane has a slender profile, and depending on its orientation relative to the direction of the air flow over it can either allow the air to pass straight through or redirect it in a sideways manner. Cross members pivotally interconnected all of the vanes to maintain them generally parallel to one another, and to move them uniformly. A small motor unit is connected to one of the cross members to oscillate the vanes side to side in unison. The vanes and cross members are assembled together and to the frame by slight flexure of the components themselves, and certain of the pivotal connections of the components are of the snap fitted type.

7 Claims, 9 Drawing Figures

FIG. 1
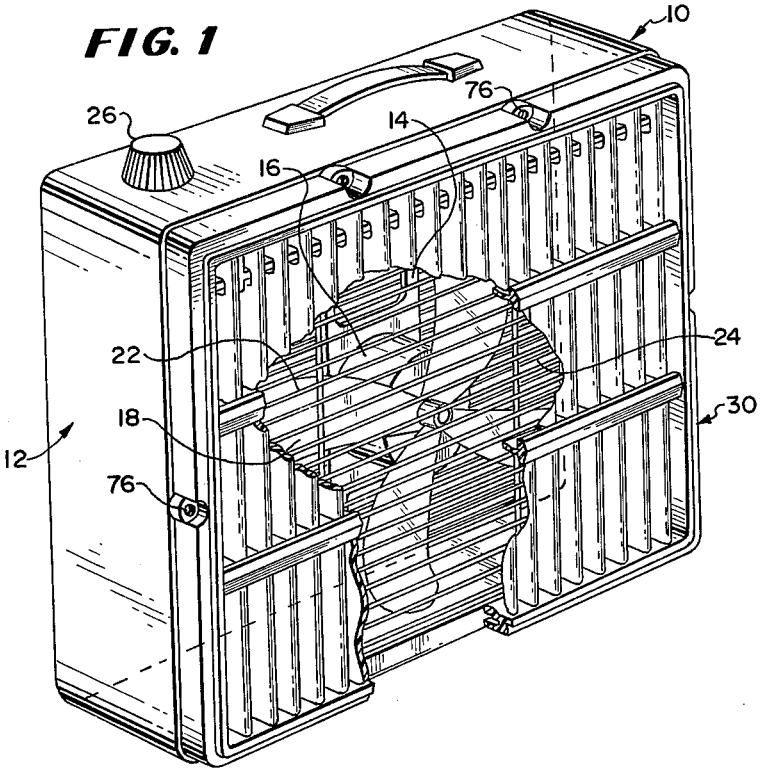
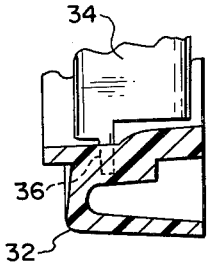
FIG. 4
FIG. 2
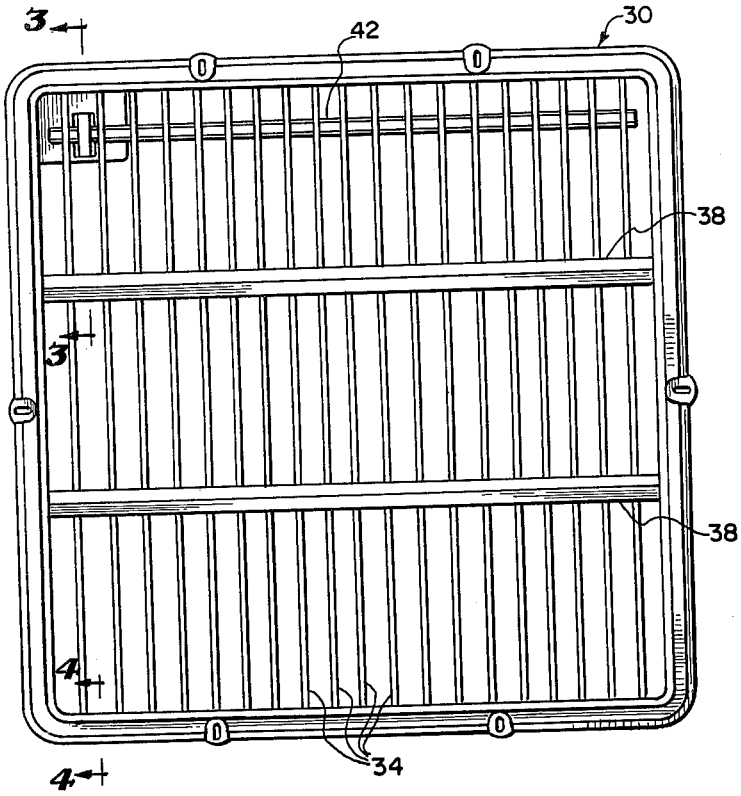
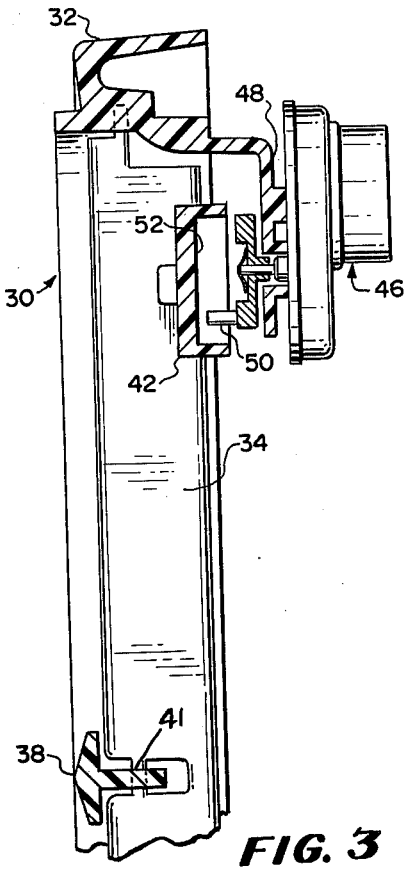
FIG. 3

FIG. 5
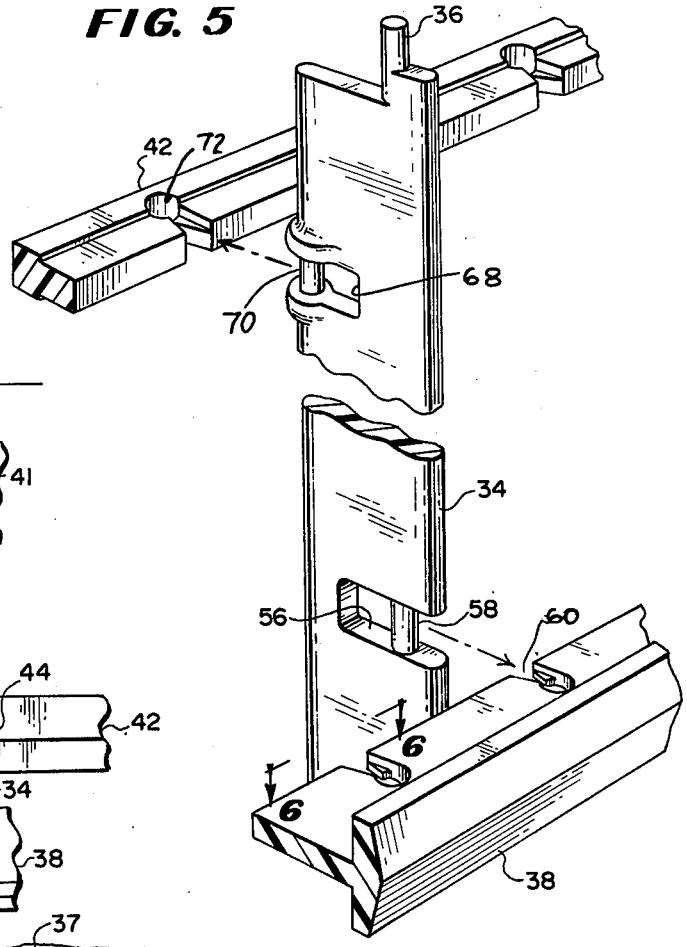
FIG. 8
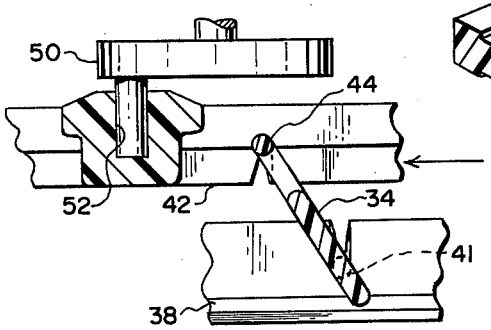
FIG. 8a
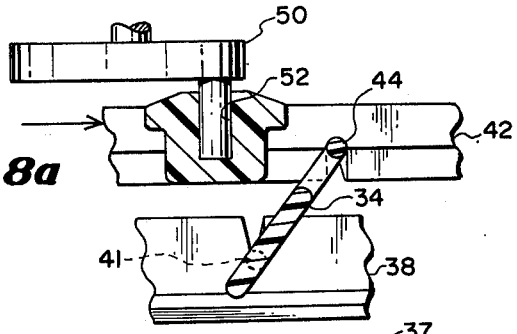
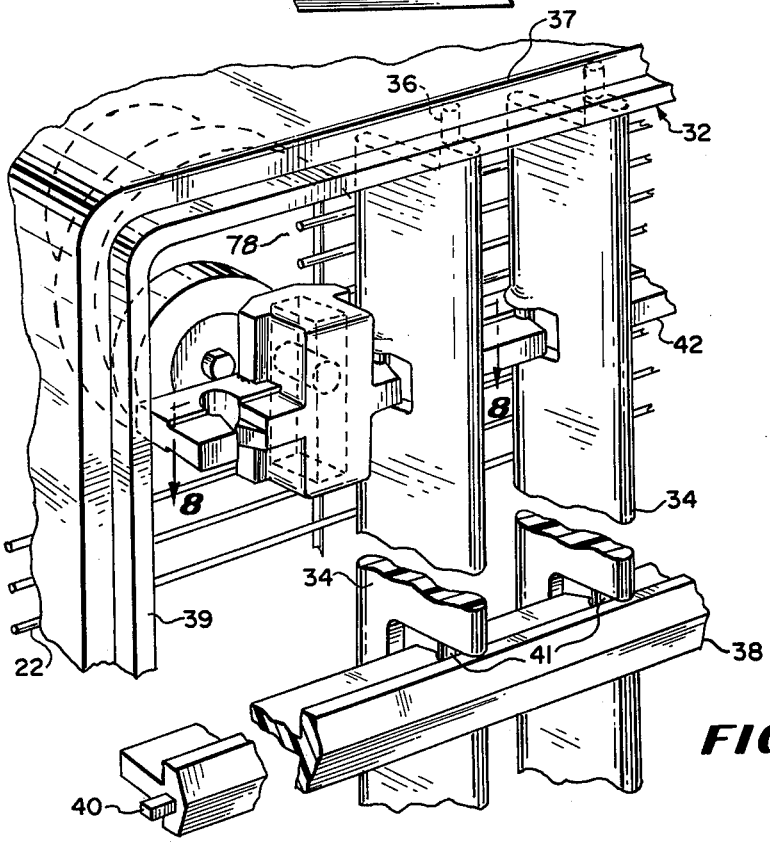
FIG. 7
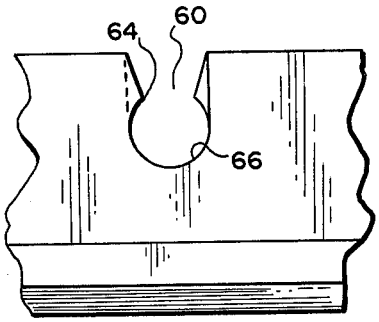
FIG. 6

OSCILLATED LOUVER ASSEMBLY FOR BREEZE BOX FAN

BACKGROUND OF THE INVENTION

In a typical fan, rotating pitched fan blades move air forwardly of the blades in a direction generally axially of the axis of blade rotation. To provide air flow patterns other than this, it has been common to move or oscillate the fan itself. Oscillating fans require that the entire fan motor, rotating fan blades, and all protective wire grill work around the moving blades be moved according to some predetermined pattern. This type construction however is suited only for small fans or only for expensive fans, since the supports that oscillate all this mass must be structural and further must be sufficiently stable to withstand tipping even in the face of the dynamic forces of the rotating blades. Typical patents that illustrate oscillating fan structures are as follows: Sundt U.S. Pat. No. 3,110,829; Price U.S. Pat. No. 3,481,534; and Chamberlain et al. U.S. Pat. No. 3,713,346.

However, no high volume discharge fans, such as those specifically known in the trade as breeze boxes, have been provided with a low cost accessory type device that offers multiple direction air flow distribution.

SUMMARY OF THE INVENTION

This invention teaches a louvered device for a breeze box type fan that redirects the typical unidirectional fan discharge to produce varied air discharge patterns. Specifically, the operating louvered device can direct the discharge in spanning up and down, or sideways oscillations while maintaining the fan housing, etc. stationary; or the louvered device stopped in a given position can continuously direct the discharge at any given angle.

The disclosed louvered device has an annular frame that is secured to the fan case to surround and be crosswise to the normal fan discharge. Separate narrow air directing vanes are pivotally supported by the frame in parallel side by side disposition, and an actuator bar is pivotally connected to each of the vanes to pitch them all in the same direction and to shift them sideways in unison. A synchronous motor mounted on the frame reciprocates the actuator bar through a yoke connection in order to oscillate the vanes according to a predetermined sweep. One or more rigid cross members can be secured to the frame and be pivotally connected to the vanes at intermediate locations along their lengths to help maintain them aligned.

BRIEF DESCRIPTION OF THE DRAWINGS

FIG. 1 is a perspective view of a breeze box fan showing a preferred embodiment of the subject louvered device secured thereon so as to operate as a unit therewith;

FIG. 2 is a front elevational view of the louvered device shown in FIG. 1;

FIGS. 3 and 4 are sectional views, enlarged for sake of clarity, as seen generally from lines 3—3 and 4—4 respectively, in FIG. 2;

FIG. 5 is an enlarged perspective view, showing several components used in the subject louvered device in preassembled orientation;

FIG. 6 is a plan view as seen generally from line 6—6 in FIG. 5;

FIG. 7 is a perspective view, somewhat similar to FIG. 5 except showing the same components connected together in an operative assembly;

FIGS. 8 and 8a are enlarged views as seen generally from line 8—8 in FIG. 7, showing the louvered device in its opposite throw positions for direction air.

DETAILED DESCRIPTION OF THE INVENTION

In the drawings, a typical breeze box fan 10 is shown having an annular case 12 with cross supports 14 for holding a motor housing 16 centered approximately within the case. A pitched fan blade assembly 18 is keyed to the motor shaft, and front grill 22 and rear grill 24 are secured to the opposite faces of the fan case to preclude the accidental touching of the blade.

Rotation of the fan blades 18 draws air in through the open rear grill and discharges it in a generally forward direction axially of the fan case out the front grill. The speed of the fan can be varied by shifting control switch 26 for increased user appeal, however the actual air flow pattern remains unidirectional.

The subject invention provides for greatly improved fan operation in that it allows alternate or multidirectional discharge patterns, even though the fan case remains stationary.

Specifically, louvered device 30 is secured to the fan housing 12 adjacent the front grill 22. The device has an annular frame 32 comprised of two pairs of opposed edge sections. Separate louvers or vanes 34 are mounted to rotate about shafts or pins 36 integrally formed at the opposite vane ends, the shafts being fitted into opposed openings in one pair 37 of the frame side sections.

A pair of cross members 38 spans the vanes crosswise at the front side thereof, and each has end pins 40 fitted into opposed openings in the other pair 39 of the frame side sections. Each cross member also has snap together pivotal connections 41 with each of the vanes coaxially of the vane mounting shafts 36. The cross members stabilize the relatively flexible vanes while yet allowing vane oscillation as will be noted.

An actuating bar 42 spans the vanes crosswise at the rear side thereof, and likewise is provided with snap together pivotal connections 44 to the vanes along a single plane spaced rearwardly of the vane mounting shafts 36.

A low power synchronous type motor unit 46 is secured to a flanged web 48 of the annular frame which unit operates through speed reduction means to power an output shaft approximately three to six rpm; and an eccentric 50 is keyed to the shaft. The actuating bar has a transverse slot 52 formed therein which can be fitted over the eccentric to define a yoke mechanical interconnection between the bar and powered eccentric. The actuator bar thus is shifted axially of itself and crosswise to the vanes a distance approximately twice the throw or offset of the eccentric from the output shaft upon rotation of eccentric, as is well known.

Each vane has a slender profile so that air flow over and beyond the vanes tends to be in parallel alignment with the vane profile. When the vanes are oriented with the profiles aligned with the normal fan discharge, there is little redirection of the discharge. However, upon vane rotation the air is redirected laterally of the normal discharge.

The louvers being powered by the synchronous motor thus redirect the air laterally or side to side from the normal fan output in a sweeping fashion three to six times per minute. By providing a separate control circuit for the louver motor, it is possible to stop the louver motor and set the louvers to any angle of discharge that might be desired; whereby continued fan discharge remains at the set pattern. The disclosed fan can thus operate at various speeds with powered louvers or at various speeds with stationary louvers set at adjustable inclinations. For a two-speed fan motor, this control can be handled with an off position for both motors with a single five-position switch; whereas for a three-speed fan motor, a single seven-position switch can be used. A separate simple on-off switch can also be used to control the louver motor, independently of the fan selector switch, if the preferred control is to have two separate switches instead of a single control switch as noted above.

Regarding the component construction, each louver has an opening or cutout 56 bounded by rounded pin or shaft section 58, and this shaft is aligned with and coaxial of the shafts 36 at the opposite vane ends. Each cross support 38 where it crosses the vanes has a keyhole slot 60 that cooperates with the vane shaft 58. The slot has narrowed shoulders 64 which are spaced apart a distance slightly less than the shaft cross dimension and further expands into a rounded section 66 which is larger than the shaft 58. The cross member is preferably of plastic, so that the resiliency of the material and the reasonably close fit of the cooperating components allows the shaft 58 to be pushed past the narrowed slot shoulders 64 and be received in the oversized rounded section 66 to establish the interlocked although pivotal connections 41 noted between the cross members and vanes.

Each vane has further a cutout 68 bounded by rounded shaft 70 which is parallel to but offset rearwardly from the shafts 36 of the same vane, and the actuating bar 42 is provided with a keyhole opening 72 (similar to that on the cross member) which can be snapped onto the vane shaft 70 to form the pivotal connection 44 of these components to one another.

As shown, there are two cross members 38 each spaced approximately a third of the way across the frame opening, so that there is stabilized support of each louver at the two opposite shaft ends and at the pivotal connections 41 with the cross members 38. The vanes can each move relative to the frame member about the respective pivot axes defined by the vane shafts 36, and the pivot axes are all parallel to one another.

In the assembly of the disclosed louver device 30, since each vane 34 has a long slender silhouette and is of a rigid but yet somewhat flexible plastic, it can be flexed across its midsection sufficiently to move the support pins 36 toward one another to accommodate thereby the positioning of them in the opposing frame openings. The actuator bar 42 is then snapped in place over each of the louvers to interconnect them. The annular frame can then be flipped over and the vanes preferably positoned in individual trough sections in a fixture, to thereby hold all of the vanes in a squared or parallel orientation, and the cross supports 38 can then be snapped onto the vanes. The end posts 40 of the cross members are then inserted into the frame openings upon flexing the frame members 39 apart slightly.

The entire louvered device 30 is secured relative to the annular fan case 12 by means of screws 76 or the like. The front grill 22 has a cutaway opening or recess 78 at one corner that corresponds with the area of the louver drive, to allow the louver drive to nest in the fan corner behind the grill.

We claim:

1. In combination, a breeze box fan having a generally rectangular case, blade means that rotate within the case to give unidirectional air discharge axially of the case, front and rear protective grills attached to said case on opposite sides of said blade means and a separate air redirection assembly constructed to be removably mounted as a unit on said fan case adjacent said front grill, said assembly including a generally rectangular frame having interconnected opposed pairs of edge sections, a plurality of separate narrow air direction vanes, opposed shaft means on each of the vanes inserted respectively in opposed openings along one pair of the edge sections for pivotally supporting the vanes crosswise to the normal air discharge on parallel pivot axes, an actuator bar, means pivotally connecting the bar to the vanes at aligned locations thereon along a single plane offset from the shaft means and on the side thereof upstream of the air flow over the vanes, operable to hold all of the vanes parallel relative to one another and to pivot them in unison, motor means mounted on said frame at a corner thereof, said front grill being cut away in alignment with said motor means to permit the latter to extend through said grill into said fan case and means connecting the output of the motor means to the actuator bar operable to reciprocate the bar and thereby oscillate the vanes about said pivot axes for side to side shifting of the vanes according to a perdetermined sweep, at least one rigid cross member conneected at its ends to the other pair of edge sections of the frame, means pivotally connecting the cross member to the vanes at aligned locations crosswise of the vanes and on centers with the pivot axes of said vanes and means for removably mounting said assembly on said fan, said means including fastener means for securing said frame to said fan case with said vanes being positioned adjacent said front grill downstream thereof in the path of air discharge from said blade means.

2. The air redirection device according to claim 1, wherein the pivotally connecting means between the vanes and the bar and the cross member each is comprised of a rounded shaft component formed on the vane and a cooperating open slot formed in the bar and in the cross member.

3. The air redirection device according to claim 2, wherein each slot on the bar and cross member is shaped as a keyhole having a central enlarged portion larger than the vane shaft component and resilient shoulder portions adjacent thereto at the open end of the slots spaced apart a distance just less than the vane shaft component.

4. The air redirection device according to claim 1, wherein each vane is generally straight and is formed of a generally rigid but flexible material such as plastic, and wherein the vane shafts are inserted in the openings of the annular frame upon initial lateral flexure of the vanes and subsequent release to allow the vane to straighten with the shafts within the openings.

5. The air redirection device according to claim 4, wherein the cross member is connected to the other pair of edge sections of the annular frame by post projections on the cross member fitting into complementary openings in the frame, wherein the annular frame is formed of a generally rigid but flexible material such as plastic, and wherein the cross members' post projections are fitted into the frame openings upon initial lateral flexure of the other pair of edge sections apart and the subsequent release with the post projections within the openings.

6. The air redirection device according to claim 5, wherein the pivotally connecting means between the vanes and the bar and the cross member each is comprised of a rounded shaft component formed on the vane and a cooperating open slot formed in the bar and in the cross member, and wherein each slot on the bar and cross member is shaped as a keyhole having a central enlarged portion larger than the vane shaft component and resilient shoulder portions adjacent thereto at the open end of the slots spaced apart a distance just less than the vane shaft component.

7. In combination, a breeze box fan having a generally rectangular case, blade means that rotate within the case, front and rear protective grills attached to said case on opposite sides of said blade means and a separate air redirection assembly constructed to be removably mounted as a unit on said fan case adjacent said front grill, said assembly including a generally rectangular frame having opposed pairs of edge sections, a plurality of separate air redirection vanes mounted for pivotal movement at opposite ends thereof between a first pair of opposed frame edge sections, said vanes being crosswise to the normal air discharge created by said blade means, an actuator bar extending transverse said vanes, means pivotally connecting said actuator bar to the vanes, said means operable to maintain said vanes in parallel alignment relative to one another and to pivot them in unison, motor means mounted on said frame, said motor means being located on the side of said frame opposite said vanes to extend into said fan case upon mounting said air redirection assembly thereon, means connecting the output of said motor means to said actuator bar operable to reciprocate said actuator bar and thereby oscillate said vanes for side to side shifting thereof according to a predetermined sweep and means for removably mounting said assembly on said fan, said means including fastener means for securing said frame to said fan case with said vanes being positioned adjacent said front grill downstream thereof in the path of air discharge from said blade means.

* * * * *